US007551882B2

(12) United States Patent
Seto et al.

(10) Patent No.: US 7,551,882 B2
(45) Date of Patent: Jun. 23, 2009

(54) IMAGE FORMING APPARATUS EQUIPPING IMPROVED TRANSFER FIXING APPARATUS

(75) Inventors: Takashi Seto, Yokohama (JP); Takashi Fujita, Yokohama (JP); Katsuaki Miyawaki, Yokohama (JP); Shin Kayahara, Yokohama (JP); Atsushi Nakafuji, Tokyo (JP); Kazumi Suzuki, Suntoh-gun (JP); Hirohmi Tamura, Ebina (JP); Hiromitsu Takagaki, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 222 days.

(21) Appl. No.: 11/757,150

(22) Filed: Jun. 1, 2007

(65) Prior Publication Data

US 2008/0008505 A1 Jan. 10, 2008

(30) Foreign Application Priority Data

Jun. 1, 2006 (JP) ..... 2006-153438

(51) Int. Cl.
*G03G 15/16* (2006.01)

(52) U.S. Cl. ..... 399/307

(58) Field of Classification Search ..... 399/121, 399/122, 297, 298, 299, 302, 307, 308
See application file for complete search history.

(56) References Cited

U.S. PATENT DOCUMENTS 5,708,938 A 1/1998 Takeuchi et al.
6,108,508 A 8/2000 Takeuchi et al.
6,526,250 B1 * 2/2003 Usui et al. ..... 399/307
6,901,234 B2 5/2005 Ogiyama et al.
7,031,648 B2 4/2006 Takashi et al.
7,127,202 B2 10/2006 Fujita et al.
7,254,362 B2 8/2007 Kikuchi et al.
7,269,384 B2 * 9/2007 Someya et al. ..... 399/307

(Continued)

FOREIGN PATENT DOCUMENTS

JP 57-41674 3/1982

(Continued)

OTHER PUBLICATIONS

U.S. Appl. No. 12/042,143, filed Mar. 4, 2008, Kayahara, et al.

(Continued)

*Primary Examiner*—Hoan H Tran
(74) *Attorney, Agent, or Firm*—Oblon, Spivak, McClelland, Maier & Neustadt, P.C.

(57) ABSTRACT

An image forming apparatus includes an image bearing member, a latent electrostatic image forming unit, a developing unit, an intermediate transferring unit which has an intermediate transfer belt and a plurality of rollers supporting the intermediate transfer belt, and a transfer fixing unit. The transfer fixing unit has a transfer fixing belt, a plurality of rollers supporting the transfer fixing belt, a heating member, and a pressurizing member forming a transfer fixing nip with the transfer fixing belt. A first roller, which is one of the plurality of rollers supporting the intermediate transferring belt, is opposite to a second roller, which is one of the plurality of rollers supporting the fixing transfer belt. The first roller and the second roller form a transfer nip between the intermediate transferring belt and the fixing transfer belt. The diameter of the first roller is smaller than the diameter of the second roller.

20 Claims, 10 Drawing Sheets

U.S. PATENT DOCUMENTS

| | | | |
|---|---|---|---|
| 2005/0286920 | A1 | 12/2005 | Baba et al. |
| 2006/0013624 | A1 | 1/2006 | Kurotaka et al. |
| 2006/0140689 | A1 | 6/2006 | Echigo et al. |
| 2007/0008395 | A1 | 1/2007 | Masubuchi et al. |
| 2007/0065188 | A1 | 3/2007 | Takagaki et al. |
| 2007/0071511 | A1 | 3/2007 | Suzuki et al. |
| 2008/0008505 | A1 | 1/2008 | Seto et al. |

FOREIGN PATENT DOCUMENTS

| | | |
|---|---|---|
| JP | 2000-250272 | 9/2000 |
| JP | 2004-145260 | 5/2004 |
| JP | 2004-271556 | 9/2004 |
| JP | 2005-181474 | 7/2005 |
| JP | 2005-189694 | 7/2005 |

OTHER PUBLICATIONS

U.S. Appl. No. 12/164,921, filed Jun. 30, 2008, Suzuki et al.
U.S. Appl. No. 12/144,078, filed Jun. 23, 2008, Kayahara et al.
U.S. Appl. No. 12/144,267, filed Jun. 23, 2008, Yasutomi, et al.
U.S. Appl. No. 11/757,150, filed Jun. 1, 2007, Seto et al.

* cited by examiner

IMAGE FORMING APPARATUS EQUIPPING IMPROVED TRANSFER FIXING APPARATUS

CROSS-REFERENCE TO RELATED APPLICATION

This patent specification is based on Japanese patent application, No. 2006-153438 filed on Jun. 1, 2006 in the Japan Patent Office, the entire contents of which are incorporated by reference herein.

BACKGROUND OF INVENTION

Field of the Invention

The present invention relates to an image forming apparatus of monochrome or color, typified by copiers, printers, facsimile or complex machines thereof, which includes a transfer fixing member which bears transferred toner images, a heating unit which heats the toner image on the transfer fixing member and a pressurizing member which forms a transfer fixing nip with the transfer fixing member, and by which the toner image on the transfer fixing member is transferred and fixed simultaneously to a recording medium such as paper passing through the transfer fixing nip to record the image on the recording medium.

SUMMARY OF THE INVENTION

According to an aspect of the invention, an image forming apparatus includes an image bearing member, a latent electrostatic image forming unit which forms a latent electrostatic image on the image bearing member, a developing unit which develops the latent electrostatic image by using a toner to form a toner image, an intermediate transferring unit which has an intermediate transfer belt and a plurality of rollers supporting the intermediate transfer belt, and transfers the toner image from the bearing member onto the intermediate transfer belt, and a transfer fixing unit. The transfer fixing unit has a transfer fixing belt transferring the toner image from the intermediate transfer belt on it, a plurality of rollers supporting the transfer fixing belt, a heating member heating the toner image on the transfer fixing belt, and a pressurizing member pressurizing the transfer fixing belt and forming a transfer fixing nip with the transfer fixing belt. A first roller, which is one of the plurality of rollers supporting the intermediate transferring belt, is opposite to a second roller, which is one of the plurality of rollers supporting the fixing transfer belt, via the intermediate transferring belt and the fixing transfer belt. The first roller and the second roller form a transfer nip between the intermediate transferring belt and the fixing transfer belt. The toner image on the transfer fixing belt is transferred and fixed simultaneously to a recording medium which passes through the transfer fixing nip to record an image on the recording medium. The diameter of the first roller is smaller than the diameter of the second roller.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
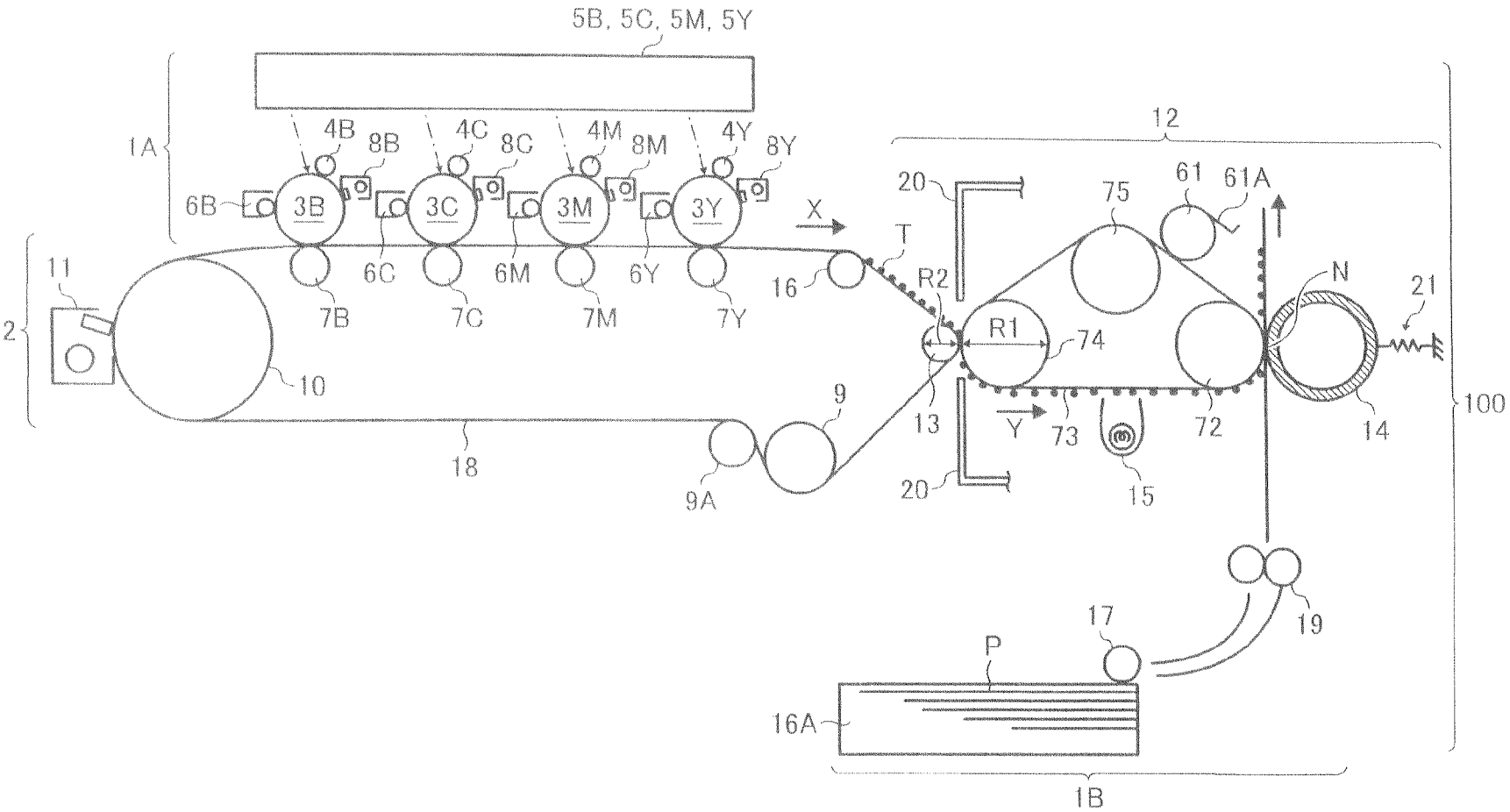
FIG. 1 is a side view of a tandem color copier according to one embodiment of the present invention.

A general outline of the composition and operation of a tandem color copier 100 of a first embodiment of the present invention will be explained with reference to FIG. 1, which is a side view of the tandem color copier 100 according to a first embodiment. A color copier 100 contains an image forming unit 1A located in the center of the copier, a paper feed unit 1B located below the image forming unit 1A and an image reading unit (not shown) located above the image forming unit 1A. An intermediate transfer belt 18 is arranged in the image forming unit 1A having a transfer surface extended in a horizontal direction and photoconductors 3B, 3C, 3M and 3Y as image bearing members which can bear images by toner of colors with complementary relations (black, cyan, magenta and yellow) are arranged along the transfer surface of the intermediate transfer belt 18. The order of each color is not limited to above. Each photoconductor 3B, 3C, 3M and 3Y and the transfer surface of the intermediate transfer belt 18 forms a nip (a first nip) respectively at which the photoconductor is in contact with the transfer surface. Each photoconductor, 3B, 3C, 3M and 3Y includes a drum which can be rotated in the same direction (in counterclockwise direction). Charging devices 4 which perform image forming process during rotating; writing devices 5 as optical writing units; developing devices 6; primary transfer rollers 7; and cleaning devices 8 are arranged around the photoconductors. The letters identifying each symbol indicate a toner color of the corresponding photoconductor 3, and developing device 6 contains a toner of different color each other.

The intermediate transfer unit 2 has the intermediate transfer belt 18, a plurality of primary transfer rollers 7B, 7C, 7M, and 7Y, a driving roller 9, tightening roller 9A, a driven roller 10, a first intermediate transfer roller 13, a belt feed roller 16 and a cleaning device 11. The intermediate transfer belt 18 moves in the direction X and is driven by a driving roller 9, which is connected to a motor (not shown). The tightening roller 9A is disposed downstream of the driving roller 9 in the direction X and tightens the intermediate transfer belt 2. The driven roller 10 and the belt feed roller 16 are disposed to arrange the intermediate transfer belt 18 at a position in contact with the four photoconductor. The primary transfer rollers 7B, 7C, 7M, and 7Y are disposed facing photoconductors respectively via the intermediate transfer belt 2 and make the first nips between the photoconductors and the belt 2 respectively. The cleaning device 11, which cleans a surface of the intermediate transfer belt 18 is disposed facing the driven roller 10. The first intermediate transfer roller 13 is disposed facing a transfer fixing unit 12 via the intermediate transfer belt 2. A surface of the photoconductor 3Y is charged uniformly by the charging device 4Y and writing is performed based on the image information provided from the image reading unit by the writing device 5 to form a latent electrostatic image on the photoconductor 3Y. The latent electrostatic image is then made visible as a toner image by attaching a toner provided from the developing device 6Y which contains Yellow toner. The toner image is primarily transferred on the intermediate transfer belt 18 by the primary transfer device 7Y to which a predetermined bias is charged. The developing device 6 stated here is not limited only to either one of one component developing device and two-component developing device. Images are formed similarly with the other photoconductors 3B, 3C and 3M differing only in color of toner and the toner image of each color is transferred at the first transfer nip to superimpose one on another in order to form a full color toner image on the intermediate transfer belt 18. The residual toner on the photoconductor 3 is removed by the cleaning device 8 after image transfer. Furthermore, electric potential of the photoconductor 3 is initialized by an electric discharging lamp (not shown) after image transferring to be ready for the next image forming process.

The paper feed unit 1B contains a paper feed tray 16, a paper feed roller 17 and a resist roller 19. The paper feed tray 16 contains recording paper P as a recording medium. The paper feed roller 17 feeds paper by separating the recording paper P in the paper feed tray 16 one by one from the uppermost paper. The resist roller 19 conveys the recording paper P to a transfer fixing nip N, which is described in detail below, by the timing in which a leading end of the image on the transfer fixing belt 73, which is described in detail below, and a predetermined position in a conveying direction agree with each other after the recording paper P might be stopped temporarily to correct a diagonal misalignment.

The transfer fixing unit 12 has a driving roller 72, a second intermediate transfer roller 74 as a second roller, a driven roller 75, the transfer fixing belt 73, a pressurizing roller 14, a spring 21, a heating member 15, a cleaning roller 61 and a stripping blade 61A. The transfer fixing belt 73 is installed with tension and supported by the driving roller 72, the second intermediate transfer roller 74, and the driven roller 75. The transfer fixing belt 73 runs towards in the direction Y shown in FIG. 1. The cleaning roller 61 is disposed in contact with the surface of the transfer fixing belt 73 to transfer a residual toner on the belt 73 with a bias voltage which is charged to the cleaning roller 61 by a power supply (not shown). The stripping blade 61A is disposed to press its edge onto the surface of the cleaning roller 61, and the residual toner transferred onto the cleaning roller 61 is stripped by the edge of the stripping blade 61A.

The first intermediate transfer roller 13 of the intermediate transfer unit 2 is opposite the second intermediate transfer roller 74 of the transfer fixing unit 12 putting the intermediate transfer belt 18 and the transfer fixing belt 73 between the roller 13 and the roller 74. The first intermediate transfer roller 13 as the first roller and the second intermediate transfer roller 74 as the second roller form a transfer nip (second nip) between the intermediate transferring belt 18 and the transfer fixing belt 73. The diameter of the first intermediate transfer roller 13 is smaller than the diameter of the second intermediate transfer roller 74 because such first intermediate transfer roller 13 and second intermediate transfer roller 74 make the area of the second nip small and prevent a heat conduction from the transfer fixing unit 12 to the intermediate transfer belt 18. It is preferable to form the diameter of the intermediate transfer roller 13 less than 15 mm and more preferable less than 10 mm because of the prevention of the heat conduction. The pressurizing roller 14 is arranged opposite to the driving roller 72 via the transfer fixing belt 73. The pressurizing roller 14 is pressed toward the driving roller 72 by the spring 21 and a transfer fixing nip N (third nip) is formed between the pressurizing roller 14 and the transfer fixing belt 73. The toner image T formed on the photoconductors 3B, 3C, 3M and 3Y as image bearing members is primarily transferred to the intermediate transfer belt 18 at the first nip. The toner image T on the intermediate transfer belt 18 is secondarily transferred to the transfer fixing belt 73 at the second nip by the bias charging unit (not illustrated). And the toner image on the transfer fixing belt 73 is transferred to the recording paper P at the third nip.

The description below expands on why it is preferable that the diameter of the intermediate transfer roller 13 is smaller than the diameter of the second intermediate transfer roller 74 besides the prevention of the heat conduction from the transfer fixing unit 12 to the intermediate transfer belt 18.

The transfer fixing belt 73 has a base belt which is wound by the driving roller 72, the second intermediate transfer roller 74 and the driven roller 75, and an elastic layer on the base belt and surface layer serves as a release layer. The base belt is made with a heat-resistant resin e.g. polyimide, or nickel whose thickness is in the range 20 to 100 μm. The elastic layer thickness is in the range 0.05 to 0.5 mm. The surface layer is made with PFA or PTFE which are fluorine resin material. The surface layer is coated on the elastic layer or formed to be tube shape with which the elastic layer is covered. The intermediate transfer belt may be thinly formed thin since it typically does not include the elastic layer or the release layer. It is also preferable to make the diameter of the second intermediate transfer roller 74 large as compared to the transfer fixing belt 73 which is comparatively thick because it includes the elastic layer and the release layer.

The transfer fixing belt 73 runs with wave shape creases on the surface of the belt 73 more frequently than the intermediate transfer belt 18 because the transfer fixing belt 73 is pressed strongly by the pressurizing roller 14 and heated by the heating member 15. When the wave shape creases on the surface of the transfer fixing belt 73 become large, the large wave shape creases makes the contact between the intermediate transfer belt 18 and the transfer fixing belt 73 at the second nip inadequate to translate the toner image from the belt 2 to the belt 73. However, the second intermediate transfer roller 74 has a bigger diameter than the intermediate transfer roller 13 of the intermediate transfer unit 2. Accordingly, the second intermediate transfer roller 74 has a larger area contacting with the belt and a larger angle wound by the belt than the intermediate transfer roller 13 of the intermediate transfer unit 2. The large area contacting the belt and the large angle wound by the belt make the inner surface of the belt adjust to wind the outer surface of the roller and, as a result, prevent the wave shape creases on the surface of the transfer fixing belt 73 from becoming large.

It is preferable that the first intermediate transfer roller 13 is made with some kind of metal and the surface material of the second intermediate transfer roller 74 is made with elastic material (e.g. rubber). The metal roller 13 prevents the surface of it from being rough by friction although the diameter of the roller 13 is relatively small. The second intermediate transfer roller 74, which has the rubber surface, causes the second nip to be small while increasing pressure power at the second nip. As a result, the intermediate transfer unit 200 can transfer the toner image to the transfer fixing unit 12 at the second nip keeping the toner density transferred onto the transfer fixing belt 73 even.

It is also preferable to make either or both of the first intermediate transfer roller 13 and/or the second intermediate transfer roller 74 with an insulator. Such rollers made with the insulator can save energy by shortening the standup time of the transfer fixing unit 12.

It is also preferable to connect the first intermediate transfer roller 13 with the second intermediate transfer roller 74 via a halfway gear connecting to the driving system (not shown) so that they can rotate in the same direction with almost the same velocity. When the diameter of the first intermediate transfer roller 13, which is rotated by the friction of the intermediate transfer belt 18, is made too small, it may not rotate smoothly because the contact area between the roller 13 and the belt 18 is too small. The too small diameter roller 13, which is rotated by the friction of the belt 18, may causes a jittery toner image on the transfer fixing belt 73. However although the diameter of the first intermediate transfer roller 13 is too small, both the first intermediate transfer roller 13 and the second intermediate transfer roller 74, which equip an end gear having the same number of the gear tooth respectively at the longitudinal end can rotate smoothly by the driving power conveyed from the halfway gear via the end gear.

An insulating wall 20 is arranged between the intermediate transfer unit 2 and the transfer fixing unit 12 to prevent the heat conduction from the transfer fixing unit 12 to the intermediate transfer unit 2. The insulating wall 20 has an opening through which the intermediate transfer belt 2 contacts with the transfer fixing belt 73. The insulating wall 20 can be equipped either to the transfer fixing unit 12 or the image forming unit 1A. It is preferable for the insulating wall 20 to be made with a metallic plate which has a low radiant heat ratio. It is further preferable for the insulating wall 20 to be formed with two metallic plates between the opening. Moreover, the insulating wall 20 may include an insulator between the two metallic plates. Moreover, the insulating wall 20 may be formed with a plate in which a heat pipe structure is formed. The heat pipe structure can be the one which is equipped to serve as a cooler in the ordinal personal computer, and prevents heat conduction without itself overheating. As a result, besides the first intermediate transfer roller 13 whose diameter is smaller than the second intermediate transfer roller 74, the insulating wall 20 also prevents the intermediate transfer belt 2 from overheating and causing a breakdown of photoconductor 3 by overheating.

Both the transfer fixing belt 73 and the pressurizing roller 14 are formed with multiple layers respectively. The belt 73 has a base belt, an elastic layer on the base belt whose thickness is from 0.05 to 0.5 mm, and a release layer which is made with fluorine resin material i.e. PFA or PTFE, and whose thickness is from 10 to 30 μm. The release layer is formed with coating process, or can be formed as a tube structure. The pressurizing roller 14 has a base metal pipe, an elastic layer on the base metal pipe whose thickness is from 0.05 to 0.5 mm, and a release layer which is made with fluorine resin material i.e. PFA or PTFE, and whose thickness is from 10 to 30 μm. The release layer is formed with coating process, or could also be formed as a tube structure.

The heating member 15 is disposed proximity to the transfer fixing belt 73 to heat the toner T on the belt 73. The heat member is formed with a halogen heater and a reflecting cover which encloses the halogen heater and reflects the light from the halogen heater. In order to measure the temperature of the transfer fixing belt 73, a thermistor (not shown) is disposed opposite to a longitudinal position of the belt 73 and may be located between the heating member and the second nip, but may also be located anywhere along the belt. The tandem color copier 100 has a temperature controller which controls the timing of turning on and off the halogen heater based on the surface temperature of the transfer fixing belt 73.

The release layer of the transfer fixing belt 73 is made with fluorine resin material in which conductive particles i.e. carbon particles are dispersed. In the transfer fixing belt 73, the base belt is made with a metal and is in contact with the release layer directly. Accordingly the release layer of the transfer fixing belt 73 can be charged the bias voltage on and make an amount of transfer bias voltage decrease. As a result, the release layer prevents the toner scatter at the second nip. It is preferable to make the release layer of the pressurizing roller 14 with fluorine resin material in which conductive particles i.e. carbon particles are dispersed.

Figure 2:
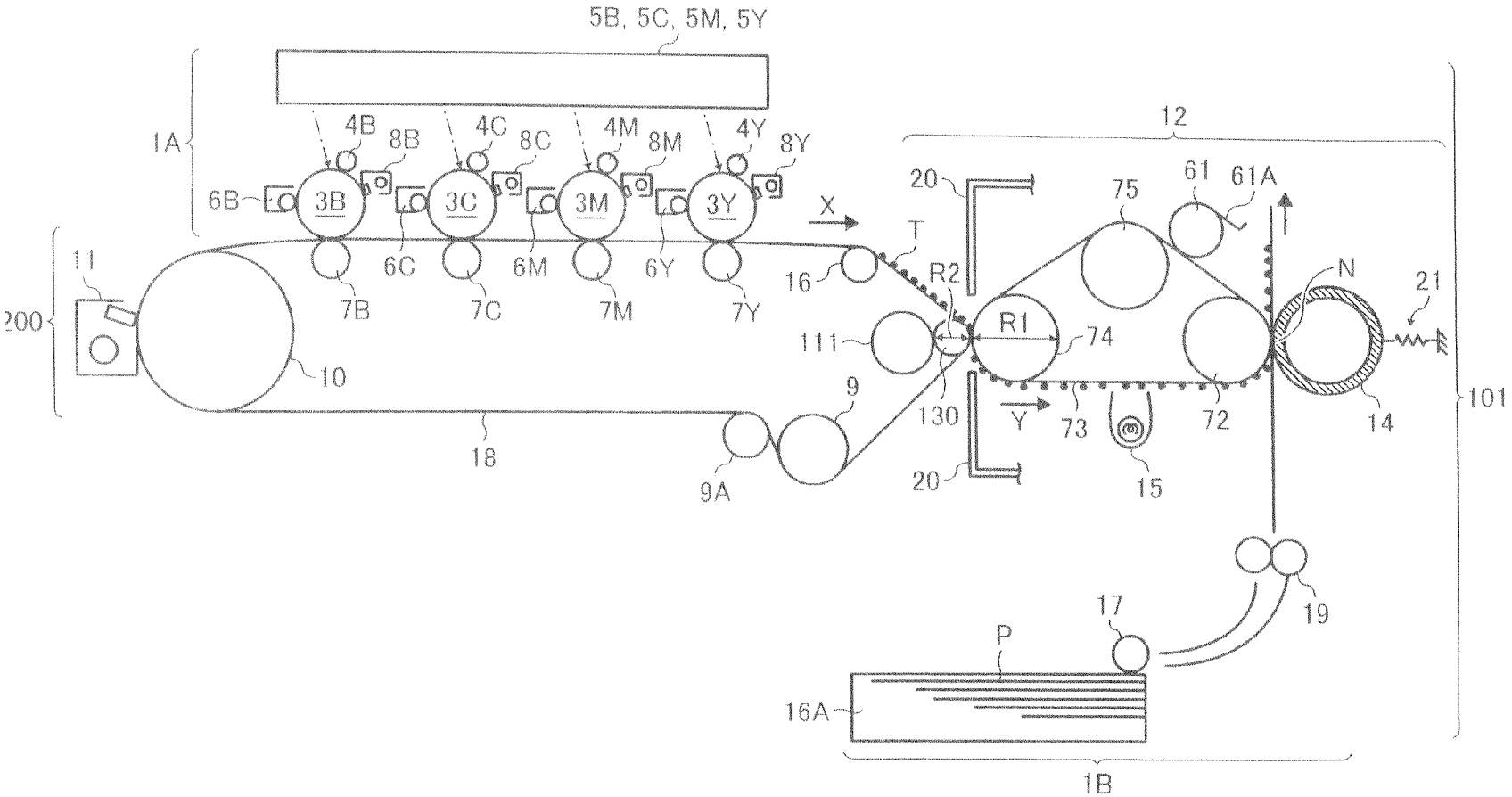
FIG. 2 is a side view of a tandem color copier according to one embodiment of the present invention.
Figure 3:
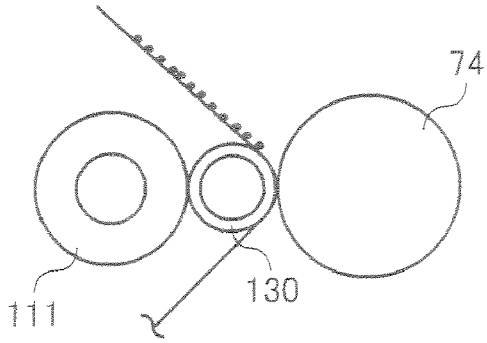
FIG. 3 is a side view of the transfer nip and peripheral structure of the nip according to one embodiment of the invention.
Figure 4:
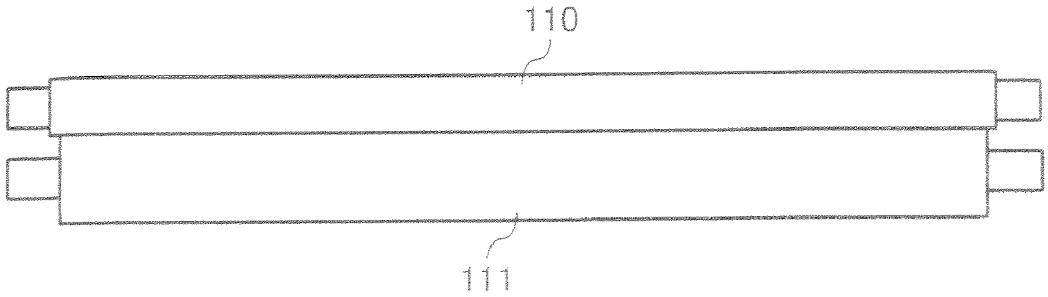
FIG. 4 is an upper view of the transfer nip and peripheral structure of the nip according to one embodiment of the invention.

An second embodiment of this invention is shown in FIGS. 2-4. In the following, the same reference mark is given to the same unit between the first embodiment and the second embodiment, and explanations thereof are not repeated. FIG. 2 is a side view of a tandem color copier 101 according to the second embodiment of the present invention. FIG. 3 is a side view of the transfer nip (the second nip) and peripheral structure of the nip. FIG. 4 is an upper view of the transfer nip (the second nip) and peripheral structure of the nip.

In FIG. 2 the intermediate transfer unit 200 has a first intermediate transfer roller 130 whose diameter is further smaller than the first intermediate transfer roller 13 in the first embodiment and a backup roller 111 arranged opposite to the second intermediate transfer roller 74 via the first intermediate transfer roller 130. Except the first intermediate transfer roller 130 and the backup roller 111, the tandem color copier 101 in the second embodiment has the same structures as the tandem color copier 100 in the first embodiment. In order to reliably transfer the toner image from the intermediate transfer belt 18 to the transfer fixing belt 73, it is preferable to make the pressure power value by the pressurizing roller 14 less than 1 kg/cm2 and more preferable in the range 200 to 300 g/cm2. The first intermediate transfer roller 130, whose diameter is smaller than the intermediate transfer roller 13 in the first embodiment, makes the pressure power value uneven in the longitudinal direction when the intermediate transfer roller 130 contacts the second intermediate transfer roller 74 via the intermediate transfer belt 18 and the transfer fixing belt 73 on the roller 130. However, in tandem color copier 101, the backup roller 111 makes the pressure power of the first intermediate transfer roller 130 even in the longitudinal direction.

In detail, the backup roller 111, whose flexural rigidity is larger than the presses the first intermediate transfer roller 130 toward the second intermediate transfer roller 74. The flexural rigidity is defined as the force couple required to bend a rigid structure to a unit curvature. In this case, the flexural rigidity of the backup roller 111 is determined by the diameter and the material of the backup roller 111. A bending amount B of the backup roller 111 is a distance between the center and the end of the roller 111 in the pressurizing direction from the second intermediate transfer roller 72 to the intermediate transfer roller 130. The amount B is shown as the formula below.

$$B=W\cdot L3/(48\cdot E\cdot I)$$

The "W" means the weight of the backup roller 111. The "L" means the length of the roller 111. The "E" means the Young ratio. The "I" means the moment of inertia of area which is $\pi\cdot d4/64$. The "d" means the diameter of the backup roller 111. In order to make the flexural rigidity large, it is preferable to make the diameter d large. For example, to make the d double decreases the bending amount of B to one sixteenth. It is also preferable to make the length L short. For example, to make the L half decreases the bending amount of B to one eighth. It is also preferable to select a material for the backup roller 111 whose Young ratio E is large. The B is in inverse proportion to the E. As shown in FIG. 3 and FIG. 4, the backup roller 111 is arranged to rotate with pushing the first intermediate transfer roller 130 in almost all range in the longitudinal direction. The backup roller prevents the first intermediate transfer roller 130 from bending at the center in the longitudinal direction, and the first intermediate transfer roller 130 pushes the fixing transfer belt 73 with the even pressure power in the longitudinal direction via the intermediate transfer belt 18.

As described above, the backup roller 111 prevents the first intermediate transfer roller 130 from bending, and makes the pressure power at the second nip even. As a result the intermediate transfer unit 200 can transfer the toner image to the transfer fixing unit 12 at the second nip keeping the toner density transferred onto the transfer fixing belt 73 even.

Figure 5:
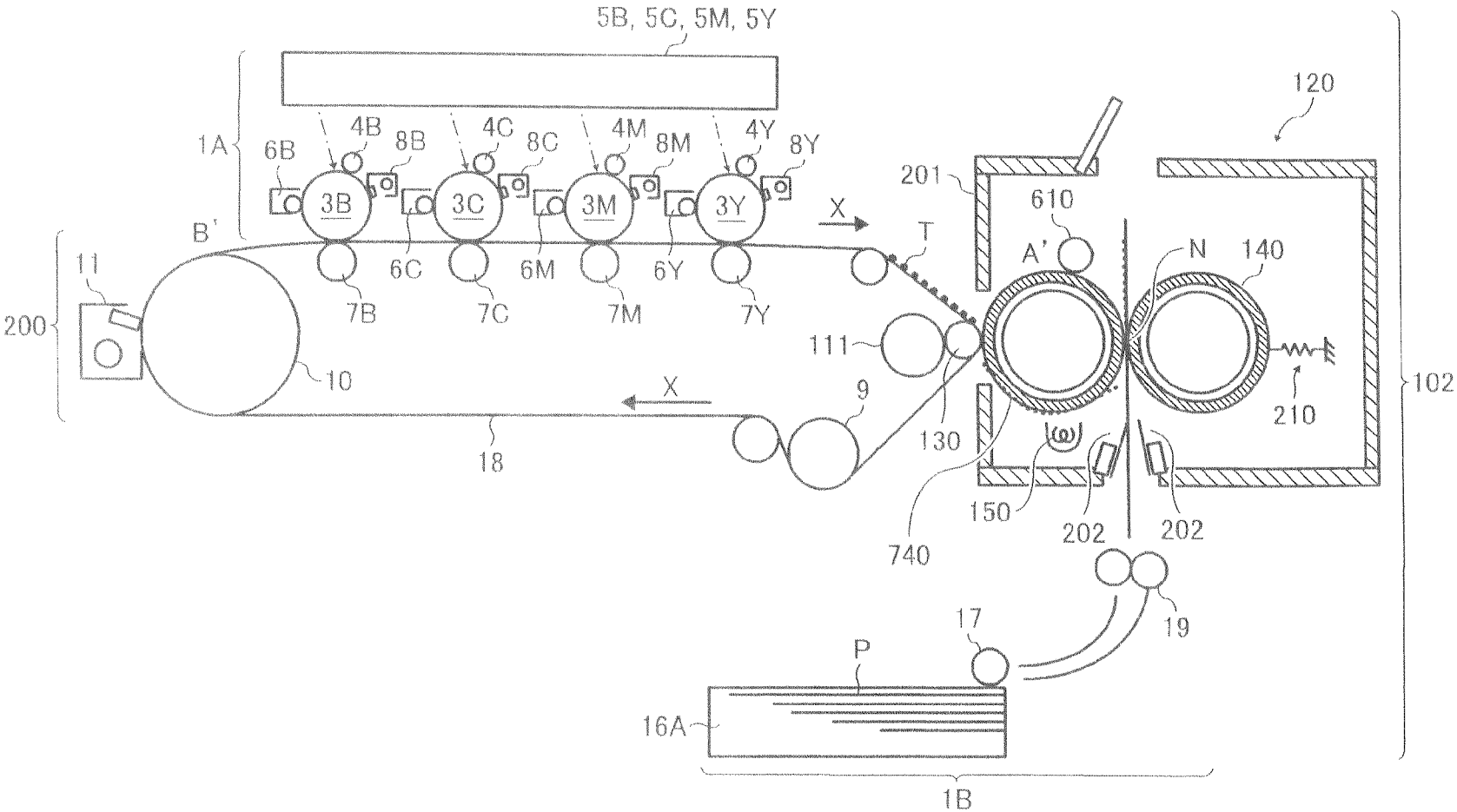
FIG. 5 is a side view of a tandem color copier according to one embodiment of the present invention.

An third embodiment of this invention is shown in FIG. 5. In the following, the same reference mark is given to the same unit between the second embodiment and the third embodiment, and explanations thereof are not repeated. FIG. 5 is a side view of a tandem color copier 102 according to Third embodiment of the present invention.

The tandem color copier 102 has a transfer fixing unit 120 which has different structures from the transfer fixing unit 12 of the first embodiment. The transfer fixing unit 120 has a transfer fixing roller 740 as a second roller, a pressurizing roller 140, a heating member 150, a cleaning roller 610, a spring 210, an insulating wall 201, and a pair of guiding plate 202. The intermediate transfer roller 130 of the intermediate transfer unit 200 is opposite the transfer fixing roller 740 of the transfer fixing unit 120 putting the intermediate transfer belt 18 between the roller 130 and the roller 740. The intermediate transfer roller 130 as the first roller and the transfer fixing roller 740 as the second roller form a transfer nip (second nip) between the intermediate transferring belt 18 and the transfer fixing roller 740. The diameter of the intermediate transfer roller 130 is smaller than the diameter of the transfer fixing roller 740 because such intermediate transfer roller 130 and transfer fixing roller 740 make the area of the second nip small and prevent a heat conduction from the transfer fixing unit 120 to the intermediate transfer belt 18. The transfer fixing roller 740 is pressed by the pressurizing roller 140 with a pressure of 5 kg/cm2 which is larger than a pressure to be needed to form the second nip.

In order to make the bending of transfer fixing roller 740 small it is preferable to make the diameter of the roller 740 large. It is preferable to form the diameter of the intermediate transfer roller 130 less than 15 mm and more preferable less than 10 mm because of the prevention of the heat conduction. The pressurizing roller 140 is arranged opposite to the transfer fixing roller 740, and is pressed toward the transfer fixing roller 740 by the spring 210 and a transfer fixing nip N (third nip) is formed between the pressurizing roller 140 and the transfer fixing roller 740.

The cleaning roller 610 is disposed in contact with the surface of the transfer fixing roller 740 to transfer a residual toner on the roller 740 with a bias voltage which is charged to the cleaning roller 610 by a power supply (not shown). The material of the surface of the transfer fixing roller 740 can be adopted the same material as the surface of the pressurizing roller 140. Both the transfer fixing roller 740 and the pressurizing roller 140 are formed with multiple layers. It is preferable that the roller 740 and the roller 140 have base metal pipes, elastic layers on the base metal pipe whose thickness is from 0.05 to 0.5 mm, and release layers which are made with fluorine resin material i.e. PFA or PTFE, and whose thickness is from 10 to 30 μm respectively. The release layer is formed with coating process, or may be formed as a tube structure. Such rollers can make the melting toner release effectively to the recording medium.

The insulating wall 201 encloses the transfer fixing unit 120 and prevents the heat conduction from the transfer fixing unit 12 to the intermediate transfer unit 2. The pair of guiding plates 202 are arranged at the bottom of the insulating wall 201 and guide the recording medium conveyed from the resist roller 19 to the third nip N.

Below is an explanation of transfer fixing process of the transfer fixing unit which equips the transfer fixing roller in the tandem color copier 102 of the third embodiment based on FIG. 6.

Figure 6:
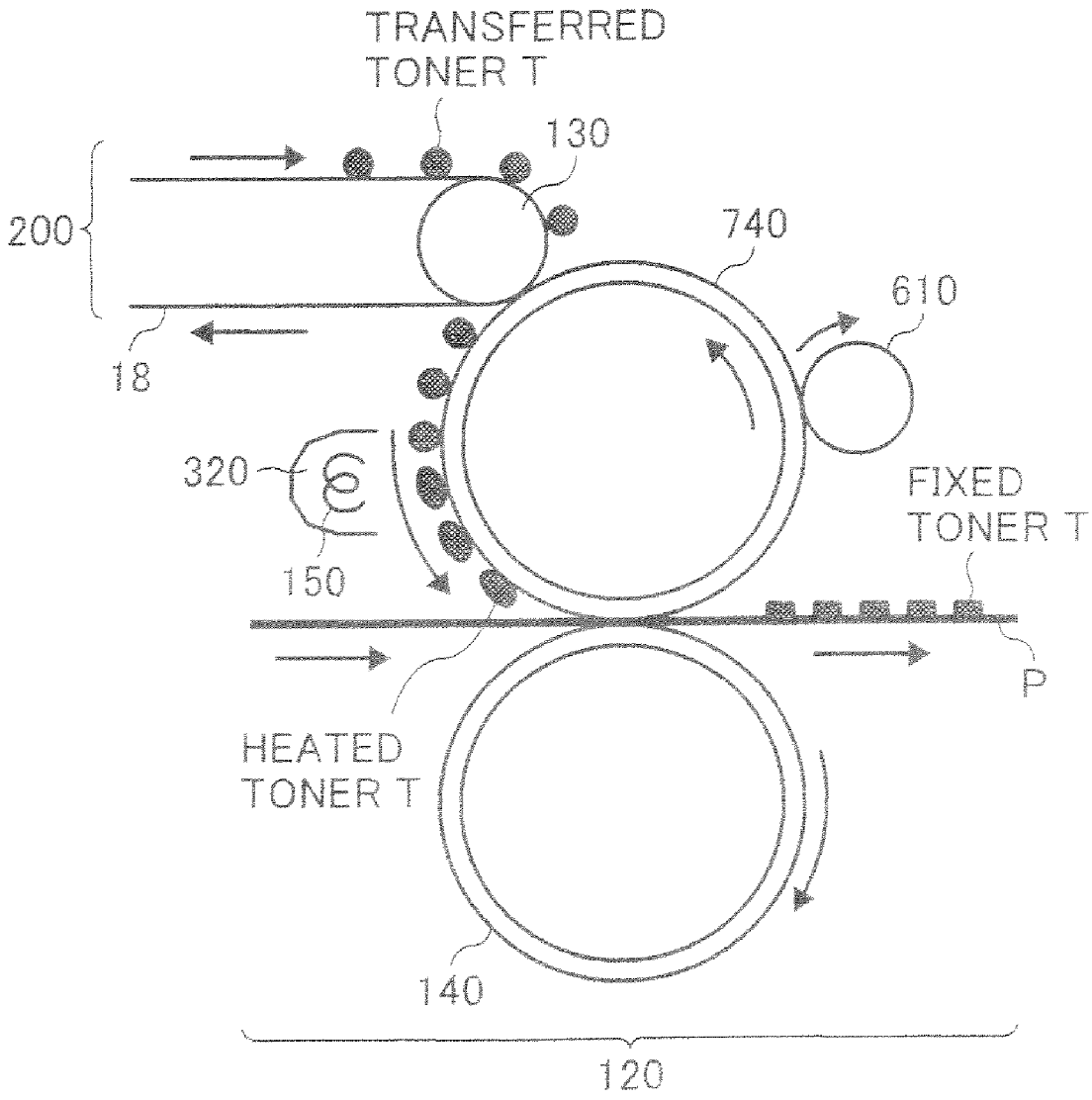
FIG. 6 is a side view of a transfer fixing unit according to one embodiment of the present invention.

FIG. 6 is a side view of a transfer fixing unit 120 according to the third embodiment of the present invention. The intermediate transfer unit 200 in FIG. 6 is simplified from the unit 200 in FIG. 5. In FIG. 6 the toner image (transferred toner T) on the intermediate transfer belt 18 is transferred from the belt 18 onto the surface of the recording sheet at a position between the intermediate transfer belt 18 and the transfer fixing roller 740. The intermediate transfer belt 18 which is wound around the first intermediate transfer roller 130 is in contact with the transfer fixing roller 740 at the position. Alternatively the belt 18 and the roller 740 may form an infinitesimal gap at the position. The toner image transferred onto the transfer fixing roller 740 is radiated by the halogen heater 150 and becomes in middle-melting condition (heated toner T) by the heat of the radiation. A reflector 320, which is formed around the halogen heater 150 and has an opening opposite to the transfer fixing roller 740, reflects the heat toward the surface of the roller 740. The surface temperature of the roller 740 is controlled by lighting on and off of the halogen heater 150 from a turning on of a electric power pack (not shown) connected with the halogen heater 150 to a starting of the copy process.

A controller (not shown) in the tandem color copier 102 controls the lighting on and off the halogen heater 150. It is preferable that the surface temperature of the roller 740 is controlled by the controller not more than 100° C. in order to avoid adding too much thermal load to the surface of the roller 740. It is further preferable the surface temperature is controlled not more than 80° C. in view of hindering the graduated deterioration of the surface of the roller 740.

At an inside space of the pressurizing roller 140, another halogen heater (not shown) is equipped, and powered by the electric power pack from turning on the electric power pack to reaching the predetermined surface temperature of the roller 740 and is turned off while the copy process is progressing. In the copy process, the electric power pack supplies its power not to the halogen heater in the pressurizing roller 140 but to the halogen heater 150.

The toner image on the transfer fixing roller 740 has a temperature distribution in the thickness direction just after the toner image passes the area opposite to the opening of the halogen heater 150 in the copy process. At that time, the upper side temperature of the toner image close to the halogen heater 150 i.e. the temperature at the part of the toner image in contact with the recording medium P is higher than the lower side temperature of the toner image close to the surface of the transfer fixing roller 740. In the third embodiment, the surface temperature of the transfer fixing roller 740 is about 80° C. except for an area from opposite position to the opening of the reflector 320 to the end position of a transfer fixing nip in the rotation direction. The area is higher than 80° C. in order to make toner image melt into the recording medium P sufficiently when the toner image fixing to the recording medium P at the transfer fixing nip.

The temperature of the toner image falls suddenly as soon as the toner image contacts with the recording medium P because a heat capacity of the toner particle is much smaller than the heat capacity of the recording medium P. In expectation of such falling of temperature, the setting temperature at the area opposite to the opening of the reflector 320 is predetermined as a contact boundary temperature between the toner image and the record medium is kept from 110 to 120° C. even at the end of the transfer fixing nip. The transfer fixing unit 120 can finish its fixing process in good condition with the contact boundary temperature. The transfer fixing process described above is basically common to the tandem color copier of the first and second embodiments. The transfer fixing process of third embodiment can be applied to the first and second embodiments by replacing the transfer fixing roller 740 with the transfer fixing belt unit 12 which contains the transfer fixing belt 73.

Figure 7:
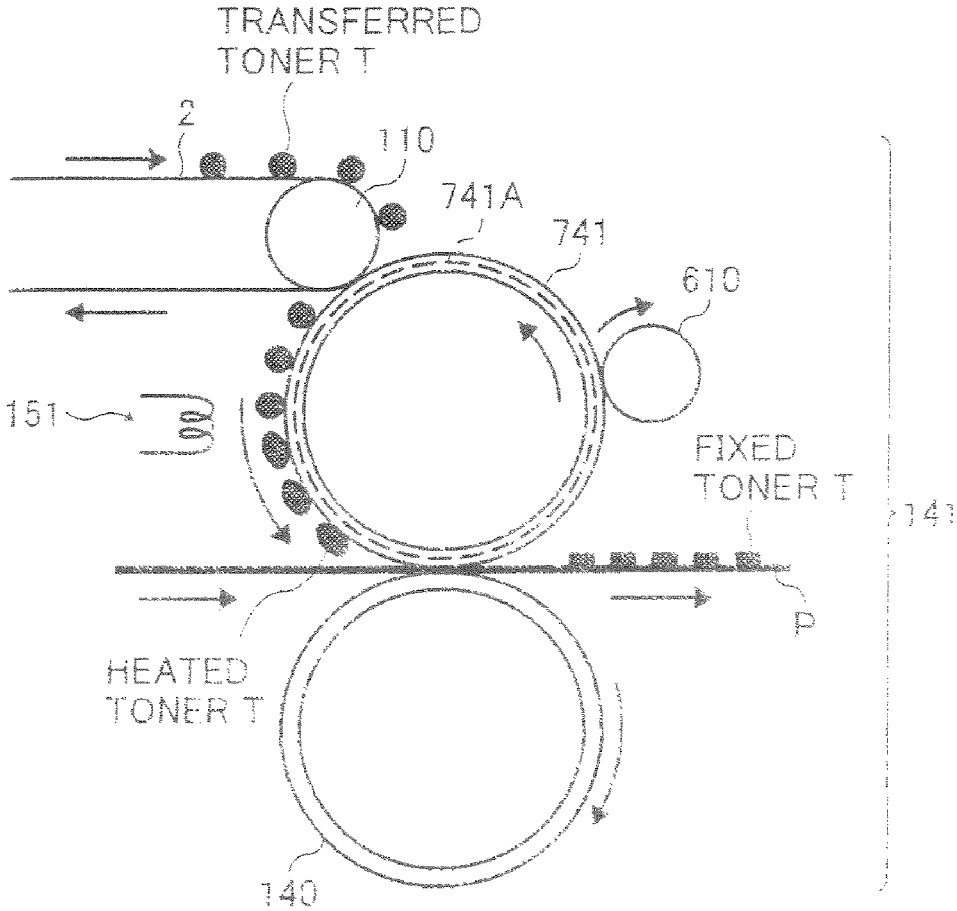
FIG. 7 is a side view of the transfer fixing unit according to one embodiment of the present invention.

Alternatively, instead of the halogen heater 150, a transfer fixing unit 141 may equip an electromagnetic-induction coil 151 for an electromagnetic-induction heating method shown in FIG. 7, which is a side view of the transfer fixing unit 141.

The transfer fixing unit 141 has the same structure as the transfer fixing unit 140 except the electromagnetic-induction coil 151 and a transfer fixing roller 741 which has a heat layer 741A, which is made with some metal e.g. silver, under the surface layer of the transfer fixing roller 741. A high frequency alternating current is provided to the electromagnetic-induction coil 151, which generates a magnetic field around the coil 151, causing an eddy current to arise in the heat layer 741A. The eddy current generates heat with the electric resistance of the heat layer 741A. The heat raises the temperature of the transfer fixing roller 741 and makes the toner on the roller 741 melt. As a result the transfer fixing unit 141 fixes the toner image on the recording medium P sufficiently at the third transfer nip.

Figure 8:
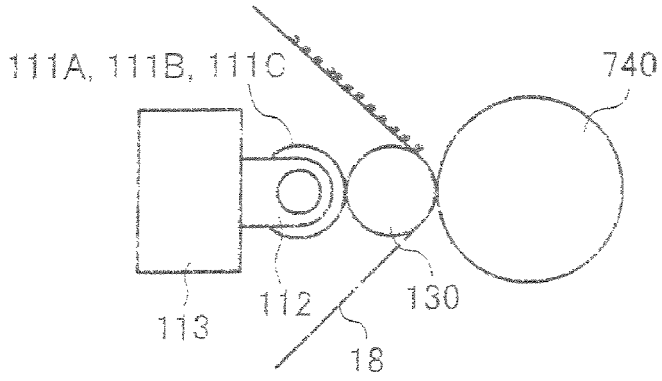
FIG. 8 is a side view of the first intermediate transfer roller and its surrounding structure according to one embodiment of the present invention.
Figure 9:
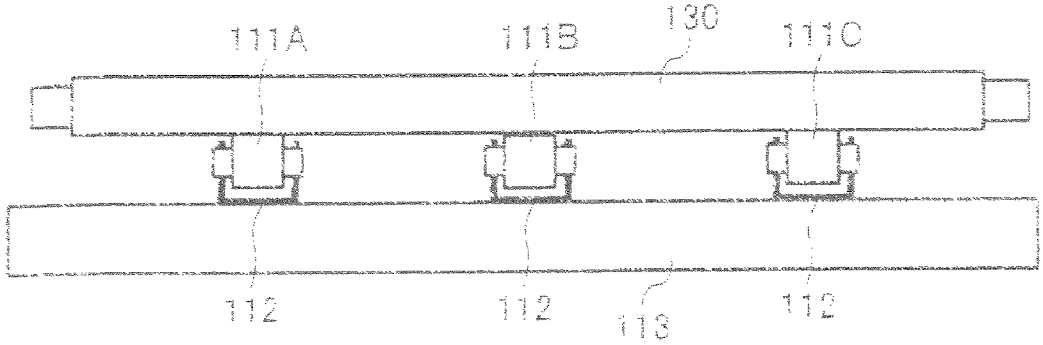
FIG. 9 is an upper view of the first intermediate transfer roller and its surrounding structure according to one embodiment of the present invention.

An fourth embodiment of this invention is shown in FIGS. 8 and 9. In the following, the same reference mark is given to the same unit among the second third embodiment and the fourth embodiment, and detailed explanations thereof are not repeated.

FIG. 8 is a side view of the first intermediate transfer roller 130 and its surrounding structure according to fourth embodiment of the present invention. FIG. 9 is an upper view of the first intermediate transfer roller 130 and its surrounding structure according to fourth embodiment of the present invention. A supporting member 113, which is made with some kind of strong material, is arranged in the intermediate transfer belt 18, and supports three brackets 112 in the longitudinal direction. Each bracket holds a backup roller 111A rotationally, which push the first intermediate transfer roller 130. Although the diameter of the backup roller 111A is small, the longitudinal bending of the backup roller 111A is kept small because the longitudinal length is also small. The backup rollers push strongly the first intermediate transfer roller 130 toward the transfer fixing roller 740. The supporting member is formed as a rectangular solid in fourth embodiment. The section of the rectangular solid is formed with a width b and a height h. The moment of inertia of area I is b·h3/12. It is preferable to make the height h so large that the support member can prevent from bending. The transfer fixing unit can adopt either belt type or roller type. In detail, the transfer fixing roller 740 in FIG. 8 can be replaced with the secondary transfer roller 74 in second embodiment, in which case the transfer fixing belt 73 is omitted.

Figure 10:
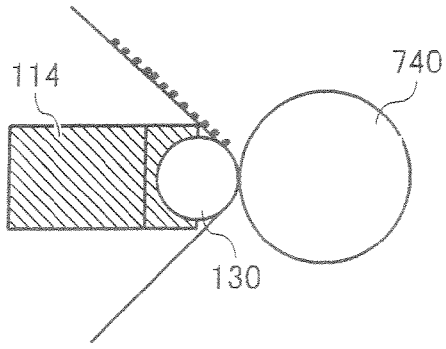
FIG. 10 is a side view of the first intermediate transfer roller and its surrounding structure according to one embodiment of the present invention.
Figure 11:
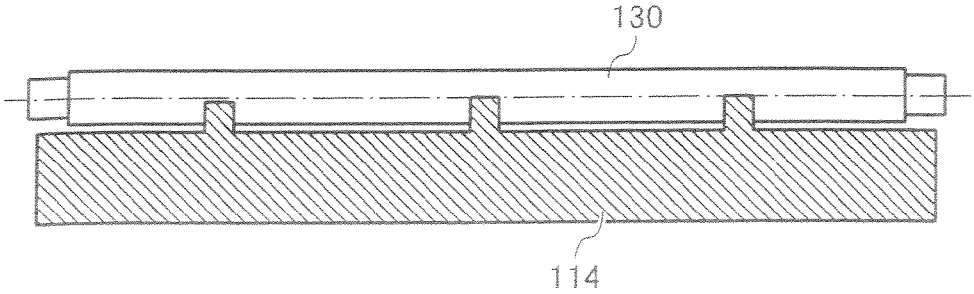
FIG. 11 is an upper view of the first intermediate transfer roller and its surrounding structure according to one embodiment of the present invention.

An fifth embodiment of this invention is shown in FIGS. 10 and 11. In the following, the same reference mark is given to the same unit among the second third embodiment and the fifth embodiment, and explanations thereof are not repeated.

Figure 12:
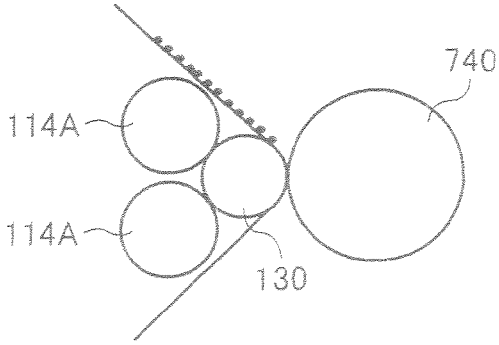
FIG. 12 is a side view of the first intermediate transfer roller and its surrounding structure according to one embodiment of the present invention.

FIG. 10 is a side view of the first intermediate transfer roller 130 and its surrounding structure according to fifth embodiment of the present invention. FIG. 11 is an upper view of the first intermediate transfer roller 130 and its surrounding structure according to fifth embodiment of the present invention. A supporting member 114, which is made with some kind of strong material, is arranged in the intermediate transfer belt 18 to hold the first intermediate transfer roller 130 at three positions in the longitudinal direction as shown in FIGS. 10 and 11. The supporting member 114 can hold the roller 130 rotationally because the material of the supporting member 114 is selected as the friction between the roller 130 and the supporting member 114 is small. The first intermediate transfer roller 130 is prevented effectively from bending because the bending stress on the roller 130 is supported by the supporting member 114 at the three positions. Alternatively, the supporting member 114 is separated two pieces as shown in FIG. 12, which is a side view of the first intermediate transfer roller 130 and its surrounding structure according to another embodiment of the present invention developed from fifth embodiment. The two supporting rollers 114A push the first transfer roller 130 at different positions in radial direction. This method of pushing enables the two supporting rollers 114A to push the roller 130 with two evenly spread powers.

Figure 13:
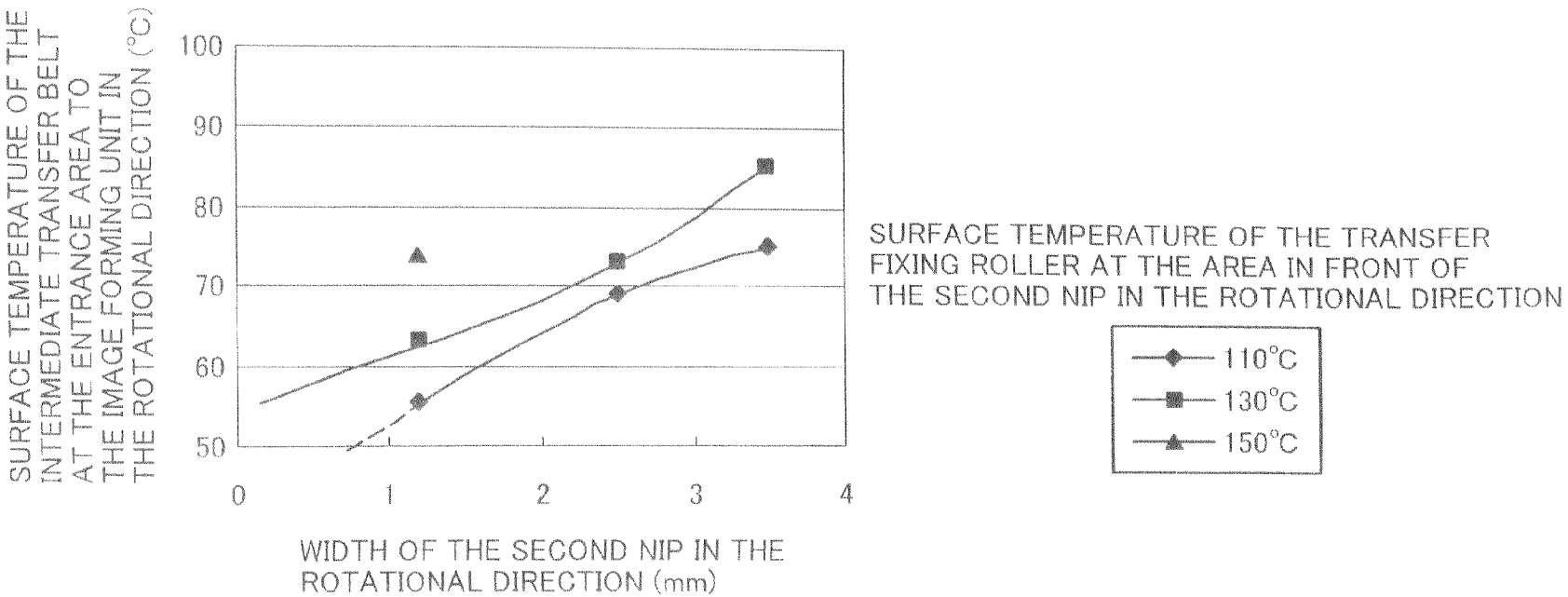
FIG. 13 is a graph showing the relationship between the width of the second nip in the rotational direction and the surface temperature of the intermediate transfer belt at an entrance area to the image forming unit in the rotational direction of the belt of the tandem color copier shown in FIG. 4.

In all of embodiments in this invention, it is preferable to make the width of the second nip in the rotational direction not more than 2 mm. In order to form the width of the second nip, it is preferable to make the diameter of the first intermediate transfer roller 130 not more than 15 mm. FIG. 13 is a graph showing the relationship between the width of the second nip in the rotational direction and the surface temperature of the intermediate transfer belt 18 at an entrance area to the image forming unit 1A in the rotational direction of the belt 18 which is equipped in the tandem color copier 101 shown in FIG. 4. The entrance area on the transfer fixing belt 18 to the image forming unit 1A in the rotational direction of the belt 18 is below B in FIG. 4. Three marks i.e. triangle, square, and lozenge show the surface temperature of the transfer fixing roller 740 at the area in front of the second nip in the rotational direction of the roller 740. The area of the roller 740 in front of the second nip is below A in FIG. 4. In order to make the measuring of the surface temperature of the intermediate transfer belt 18 precise, it is preferable to leave the intermediate transfer belt 18 for a fixed period from stopping of the belt 18, and measure. The fixed period is 15 minutes in FIG. 13. When the width of the second nip in the rotational direction is set at not more than 2 mm and the surface temperature of the transfer fixing belt 740 is from 110 to 130° C., and the surface temperature of the intermediate transfer belt 18 below B is under 70° C. In those conditions, the intermediate transfer belt 18 prevents the photoconductors 3B, 3C, 3M and 3Y from being filmed and stuck by the melting toner.

Figure 14:
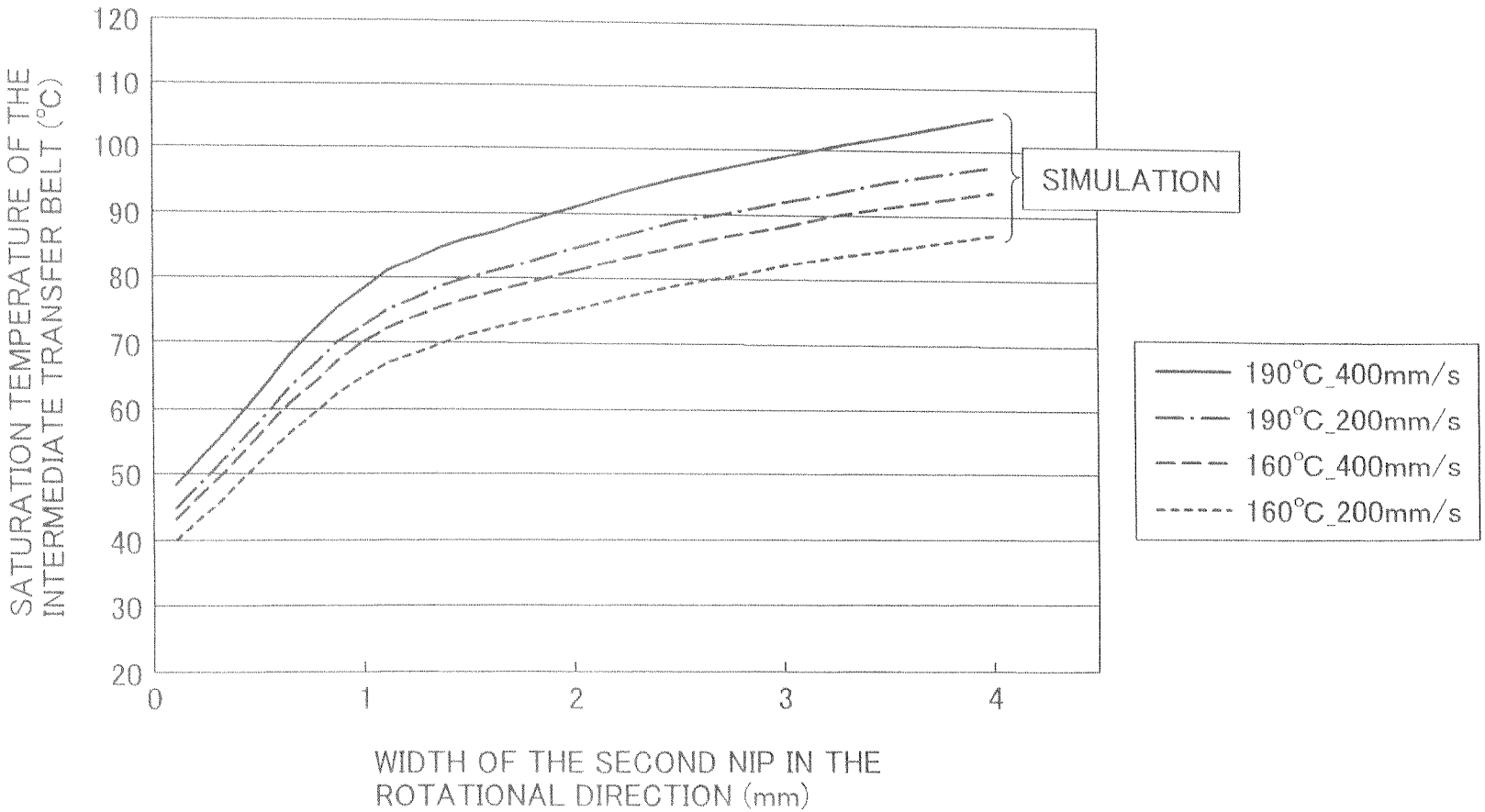
FIG. 14 is a graph showing a simulation result of the relationship between the width of the second nip in the rotational direction and a saturation temperature of the intermediate transfer belt.

FIG. 14 is a graph showing a simulation result of the relationship between the width of the second nip in the rotational direction and a saturation temperature of the intermediate transfer belt 18 below B. In this simulation, the saturation temperature is defined as a temperature at the time when a temperature variation per one minute becomes not more than 0.1° C. Four curves drown with different type line means different conditions of the transfer fixing roller 740. The temperature beside the line in the right side box is the surface temperature of the transfer fixing roller 740 below A. The velocity beside the temperature in the right box is the rotational velocity of the transfer fixing roller 740. The smaller the width of the second nip is set, the lower the surface temperature of the intermediate transfer becomes in this simulation result. This result has the same decreasing tendency of the surface temperature of the intermediate transfer belt 18 as the result in FIG. 13. This setting of width of the second nip, which is set it at not more than 2 mm, can adopt either the belt type or the roller type of the transfer fixing unit.

The toner that is employed in all of the Embodiments of this invention will now be described. The transferring performance of the toner at the second nip influences the quality of image and is influenced by the toner shape. It is preferable to employ a toner whose Wadell's practical sphericity of the toner particle is equal to or more than $\phi 0.8$ in the developing device 6 in order to transfer the toner image at the second nip. Wadell's practical sphericity $\phi$ of the toner particle is calculated by the below formula.

$\phi$=(a diameter of a circle whose area is equal to the projected area of a toner)/(a diameter of a circle circumscribing the projected area of a toner)

In detail, the $\phi$ can be calculated using the measuring result of the toner samples below. The measurement is done with sampling a hundred of toner and observing them by a 500-power microscope.

What is claimed is:

1. An image forming apparatus, comprising:

an image bearing member;

a latent electrostatic image forming unit configured to form a latent electrostatic image on the image bearing member;

a developing unit configured to develop the latent electrostatic image by using toner to form a toner image;

an intermediate transferring unit configured to have an intermediate transfer belt and a plurality of rollers supporting the intermediate transfer belt and to transfer the toner image from the bearing member onto the intermediate transfer belt; and a transfer fixing unit comprising a transfer fixing belt configured to receive the toner image transferred from the intermediate transfer belt, a plurality of rollers configured to support the transfer fixing belt, a heating member configured to heat the toner image on the transfer fixing belt, and a pressurizing member pressurizing the transfer fixing belt and forming a transfer fixing nip with the transfer fixing belt; wherein a first roller, which is one of the plurality of rollers supporting the intermediate transferring belt, is opposite to a second roller, which is one of the plurality of rollers configured to support the transfer fixing belt, and the first roller and the second roller form a transfer nip between the intermediate transferring belt and the transfer fixing belt, the toner image on the transfer fixing belt is transferred and fixed simultaneously to a recording medium which passes through the transfer fixing nip to record an image on the recording medium, and the diameter of the first roller is smaller than the diameter of the second roller.

2. The image forming apparatus of claim 1, wherein the transfer fixing nip is equal to or less than 2 mm.

3. The image forming apparatus of claim 2, wherein the diameter of the first roller is equal to or less than 15 mm.

4. The image forming apparatus of claim 2, further comprising:

a backup member configured to be arranged opposite to the second roller via the first roller and to press the first roller toward the second roller.

5. The image forming apparatus of claim 4, wherein the backup member comprises at least one roller.

6. The image forming apparatus of claim 4, wherein the backup member comprises at least one sliding bearing configured to support the first roller as it rotates.

7. The image forming apparatus of claim 1, wherein the first roller is comprised of a metal material and the second roller is comprised of an elastic material.

8. The image forming apparatus of claim 1, further comprising:

an insulating wall arranged between the intermediate transfer unit and the transfer fixing unit.

9. The image forming apparatus of claim 1, wherein at least either the first roller or the second roller includes a surface layer comprising an insulator.

10. The image forming apparatus of claim 1, further comprising:

a driving unit configure to rotate the first roller and the second roller, wherein the first roller has a first coaxial gear with the rotatable axis of the roller, the second roller has a second coaxial gear with the rotatable axis of the roller, and the driving unit is configured to connect with the first and second coaxial gears to rotate the first roller and the second roller at the substantial same speed in the same rotational direction.

11. The image forming apparatus of claim 1, wherein the transfer fixing belt comprises a release layer on the surface thereof.

12. The image forming apparatus according to claim 1, wherein the developing unit contains a toner whose Wadell's practical sphericity of the toner particle is equal to or more than $\phi 0.8$.

13. An image forming apparatus, comprising:

an image bearing member;

a latent electrostatic image forming unit configured to form a latent electrostatic image on the image bearing member;

a developing unit configured to develop the latent electrostatic image by using a toner to form a toner image;

an intermediate transferring unit configured to have an intermediate transfer belt and a plurality of rollers supporting the intermediate transfer belt and to transfer the toner image from the bearing member onto the intermediate transfer belt; and a transfer fixing unit comprising a transfer fixing roller and configured to transfer the toner image from the intermediate transfer belt thereon, the transfer unit also comprising a heating member configured to heat the toner image on the transfer fixing roller, and a pressurizing member configured to pressurize the transfer fixing roller to form a transfer fixing nip with the transfer fixing roller, wherein a first roller, which is one of the plurality of rollers supporting the intermediate transferring belt, is opposite to the transfer fixing roller via the intermediate transferring belt, and the first roller and the transfer fixing roller form a transfer nip between the intermediate transferring belt and the transfer fixing roller, the toner image on the transfer fixing roller is transferred and fixed simultaneously to a recording medium which passes through the transfer fixing nip to record an image on the recording medium, and the diameter of the first roller is smaller than the diameter of the transfer fixing roller.

14. The image forming apparatus of claim 13, wherein the transfer fixing nip less than or equal to 2 mm.

15. The image forming apparatus according to claim 14, wherein the diameter of the first roller is less than or equal to 15 mm.

16. The image forming apparatus according to claim 13, further comprising:

a backup member configured to be arranged opposite to the transfer fixing roller via the first roller and to press the first roller toward the transfer fixing roller.

17. The image forming apparatus according to claim 16, wherein the backup member comprises at least one roller.

18. The image forming apparatus according to claim 16, wherein the backup member comprises at least one sliding bearing which rotatably supports the first roller.

19. The image forming apparatus according to claim 13, wherein the transfer fixing roller comprises a release layer on the surface thereof.

20. The image forming apparatus according to claim 13, wherein the developing unit contains a toner whose Wadell's practical sphericity of the toner particle is equal to or more than $\phi 0.8$.

* * * * *